United States Patent [19]

Dunton et al.

[11] Patent Number: 4,830,505

[45] Date of Patent: May 16, 1989

[54] PARTICLE WETTING PROCESS AND APPARATUS

[75] Inventors: Harvey R. Dunton, Anaheim; Donald H. Rez, Newport Beach, both of Calif.

[73] Assignee: Standard Concrete Materials, Inc., Santa Ana, Calif.

[21] Appl. No.: 194,227

[22] Filed: May 16, 1988

[51] Int. Cl.[4] ..... B28C 5/08

[52] U.S. Cl. ..... 366/2; 366/14; 366/16; 366/28; 366/34; 366/136; 366/138

[58] Field of Search ..... 366/2, 6, 14, 15, 16, 366/17, 18, 19, 27, 28, 29, 30, 33, 34, 40, 136, 137, 138, 141

[56] References Cited

U.S. PATENT DOCUMENTS

| | | | |
|---|---|---|---|
| 2,316,705 | 4/1943 | Morgan | 366/2 |
| 2,432,971 | 12/1947 | Ruthman et al. . | |
| 2,549,507 | 4/1951 | Morgan et al. . | |
| 2,600,018 | 6/1952 | Nelson et al. . | |
| 2,629,667 | 2/1953 | Kaveler . | |
| 2,684,714 | 12/1958 | Dixon et al. . | |
| 2,700,615 | 1/1955 | Heijmer . | |
| 2,820,713 | 1/1958 | Wagner . | |
| 2,959,489 | 11/1960 | Wagner . | |
| 3,030,258 | 4/1962 | Wagner . | |
| 3,169,877 | 2/1965 | Bartoli . | |
| 3,215,549 | 11/1965 | Ericson . | |
| 3,676,075 | 7/1972 | Ploger | 366/137 |
| 3,967,815 | 7/1976 | Backus et al. . | |
| 4,039,170 | 8/1977 | Cornwell et al. . | |
| 4,185,923 | 1/1980 | Bouette et al. . | |
| 4,199,547 | 4/1980 | Levinsky et al. . | |
| 4,275,033 | 6/1981 | Schulte et al. . | |
| 4,328,178 | 5/1982 | Kossatz . | |
| 4,372,352 | 2/1983 | Coppola et al. . | |
| 4,448,536 | 5/1984 | Strong . | |
| 4,585,486 | 4/1986 | Fujita et al. . | |
| 4,588,299 | 6/1986 | Brown | 366/8 |
| 4,599,208 | 7/1986 | Blaak . | |
| 4,705,405 | 11/1987 | Williams . | |
| 4,764,019 | 8/1988 | Kaminski | 366/136 |

OTHER PUBLICATIONS

Defensive Publication T948,009, 7/76.

Chemical Engineer's Handbook, Perry & Chillon eds., McGraw-Hill, 5th edition, 1973, pp. 8-50.

*Primary Examiner*—Robert W. Jenkins

*Attorney, Agent, or Firm*—William W. Haefliger

[57] ABSTRACT

A method of mixing particulate cement and water in a primary mixing vessel to form a slurry batch, includes introducing a measured quantity of water into the vessel, introducing a measured quantity of particulate cement into the vessel, agitating the water and cement in the vessel to form a slurry, and while continuing such agitating, pumping slurry from the lower interior extend of the vessel and delivering the pumped slurry to the upper interior of the vessel, at high velocity, removing slurry from the vessel for flow to an auxiliary mixing vessel for mixing with aggregate, and employing wash water to wash remanent slurry from surfaces in the primary mixing vessel for flow to the auxiliary vessel.

27 Claims, 4 Drawing Sheets

4
3
2
14
$V_3$
$V_1$
13
45
$V_4$
210
43
16
$V_2$
12
15
$V_7$
47
48
10
46
11
50
21
21
22
22
11a
36
38
P
$D_3$

FIG. 3.
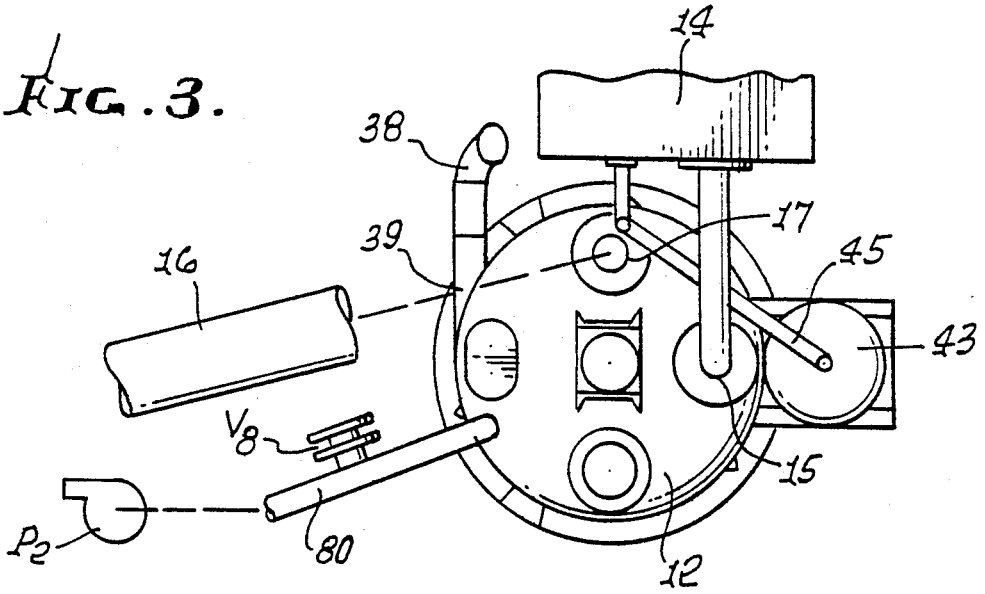
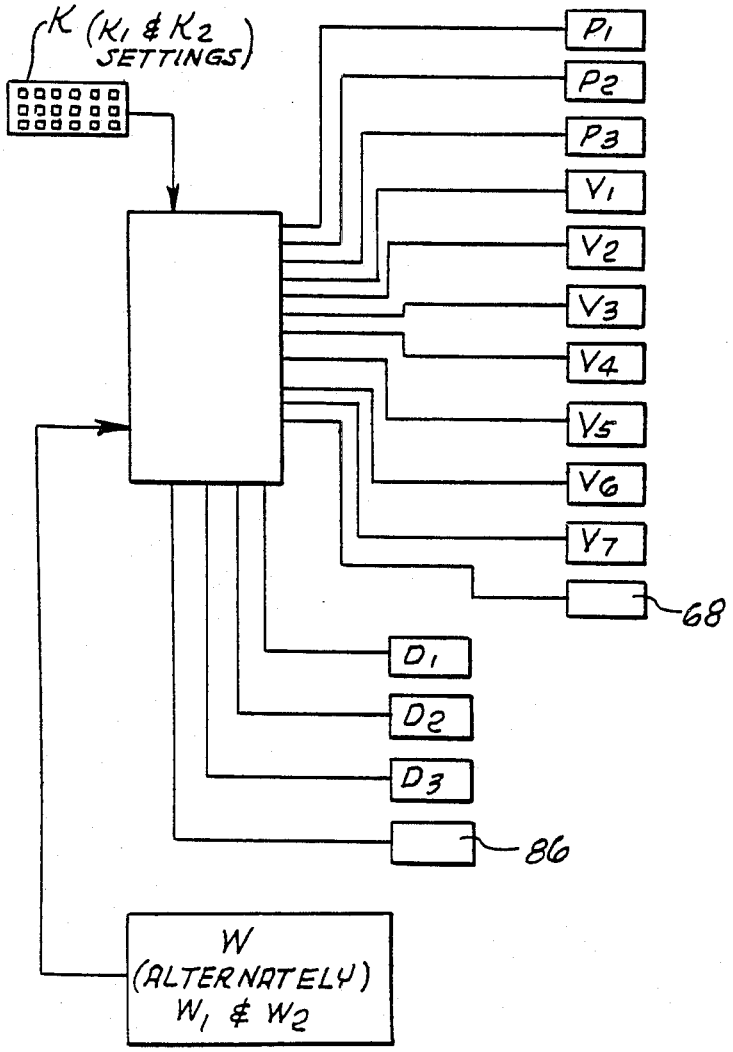
FIG. 5.

PARTICLE WETTING PROCESS AND APPARATUS

BACKGROUND OF THE INVENTION

This invention relates generally to mixing of calcareous cement particles or powders, and water, for use in making concrete; and more particularly it concerns an unusually useful and efficient process, and associated apparatus, for performing the steps of the process, to effect efficient cement and water mixing, i.e. batching.

Problems associated with present dry cement, water and aggregate batching procedures, as in truck mounted rotary containers to which such ingredients are supplied, include: excessive cement dust formation and escape into the atmosphere; "balling" of cement particles and water (i.e. formation of unwetted cement agglomerates in partially wetted balls; and build-up of unwetted cement powder, as well as slurry, on rotary mixer surfaces). These also contribute to production of concrete mixes characterized by out-of-proportion ingredients, leading to reduced strength concrete. There is need for a precise, controlled, and otherwise highly efficient cement and water mixing or batching process that overcomes such problems and difficulties.

SUMMARY OF THE INVENTION

It is a major object of the invention to provide an improved and highly efficient process, and controlled system, that meets the above needs. Basically, the process of the invention involves use of a primary mixing vessel in which a cement and water slurry is produced, the process including the steps:

(a) introducing a measured quantity of water into the vessel, (b) introducing a measured quantity of particulate cement into the vessel, (c) agitating the water and cement in the vessel to form a slurry;

(d) and, while continuing said agitating, pumping slurry from the lower interior extent of the vessel and delivering the pumped slurry to the upper interior of the vessel, at high velocity, (e) removing slurry from the vessel for flow to an auxiliary mixing vessel for mixing with aggregate, (f) and employing wash water to wash remanent slurry from surfaces in the primary mixing vessel and removing the wash water and remanent slurry from the primary vessel for flow to the auxiliary vessel.

Typically, multiple rotary agitators are employed in the vessel, and operated to create streams of slurry which impinge upon one another in that vessel; also, the agitators advantageously include upper and lower bladed agitators rotated in a direction or directions so that the upper agitator drives slurry in a stream toward the lower agitator, and so that the lower agitator drives slurry in a stream toward the upper agitator, whereby the two streams impinge upon one another. Enhanced wetting of cement particles can be obtained by evacuating air from the interior of the primary vessel after mixing of the water and cement, then rapidly re-admitting air to the primary vessel, thereby enhancing wetting of the cement particles in the slurry.

Further, a wash water holding tank is typically provided, and the method includes adding to that tank a fixed fraction of said predetermined amount of water, for use as said wash water. The water in the holding tank is pressurized, as by application of air pressure, for delivery of pressurized water streams to the vessel interior to wash down said surfaces in the primary mixing vessel.

The same pump as is used in a first mode for recirculating slurry to the vessel interior, at high velocity, can also be employed in a second mode to rapidly pump the slurry from the cement and water batching vessel to an auxiliary vessel (such as the rotating container on a "ready-mix" truck), for mixing with aggregate (sand or rock) delivered to that auxiliary vessel; and the amount of water added to the batching vessel can be reduced (under computer control) in proportion to the amount of water that is carried by wet sand in such aggregate, so as to arrive at an ultimate concrete mix with correct water content.

The batching apparatus of the invention basically comprises:

(a) a primary mixing vessel having cement and water inlet means, and slurry outlet means, (b) means for introducing measured quantities of water and cement into the vessel, (c) agitation means for agitating the cement and water in the vessel, thereby to form the slurry, (d) means including a pump for removing a stream of slurry from the lower interior of the vessel and flowing said stream into the upper interior of the vessel, at high velocity, and for removing slurry from the vessel for flow to an auxiliary mixing vessel for mixing with aggregate, (e) and washing means including a wash water holding tank for supplying wash water to the interior of the vessel so as to wash remanent slurry from surfaces in that vessel for flow out of the primary vessel and to the auxiliary vessel.

Also provided is apparatus to produce agitation in the vessel, without need for rotating blades, and for removing cement dust from the vessel upper interior, to be re-introduced in a slurry re-circulation stream that acts to produce agitation.

These and other objects and advantages of the invention, as well as the details of an illustrative embodiment, will be more fully understood from the following specification and drawings, in which:

DRAWING DESCRIPTION

FIG. 3 is a plan view taken on lines 3—3 of FIG. 1;

FIG. 5 is a block diagram showing computer control of actuators and valves associated with the apparatus.

DETAILED DESCRIPTION

Figure 1:
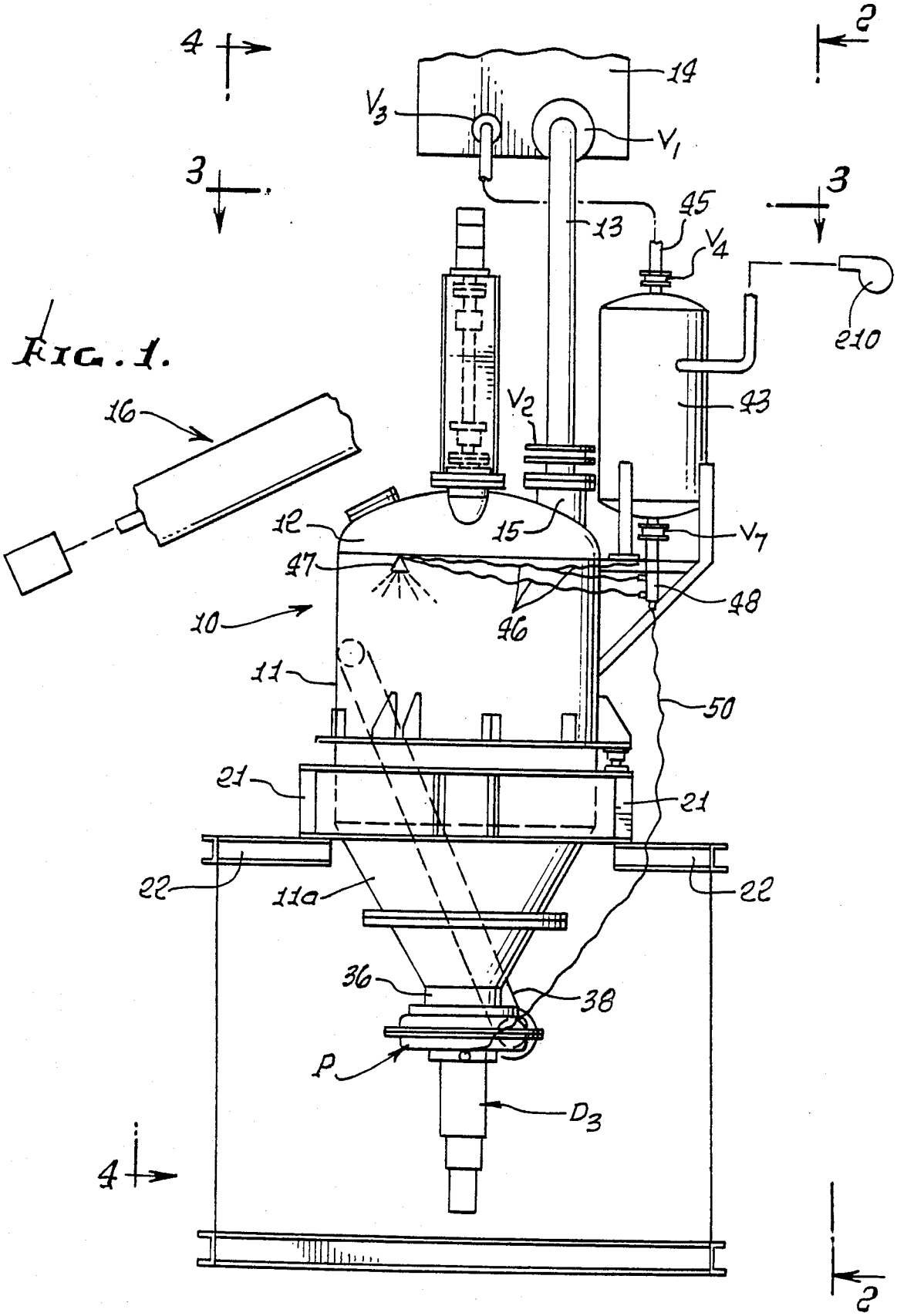
FIG. 1 is an elevation showing apparatus in accordance with the invention.

The apparatus seen in FIGS. 1–4 includes an upright primary mixing vessel 10 having a cylindrical side wall 11, a top cover 12, and a tapering lower extension 11a of wall 11. A water fill line 13 extends downwardly from a water storage tank 14, toward a water inlet 15 in cover 12. Valve $V_1$ in line 13 controls water egress from the storage tank 14, and a control valve $V_2$ in and at the lower end of line 13 controls water admission to the vessel 10. Calcareous cement in particle form (as for example Portland cement) is conveyed by screw conveyor 16 toward a cement inlet 17 in cover 12. A drive $D_1$ for the conveyor is operable and controlled, as by computer 19 seen in FIG. 5, to cause a measured amount of cement to be conveyed at 16 and introduced via inlet 17 into the vessel 10 immediately after a measured amount of water is admitted to the vessel. For this purpose, the vessel is mounted via load cells 21 to frame structure 22. The outputs of the load cells, represented by weight signal W (net of tare weight of the vessel) in FIG. 5, is transmitted to the computer, as shown. Also, desired water weight $K_1$ and cement weight $K_2$ settings are keyed into the computer, via keyboard K, as shown. Initially, the computer opens valves $V_1$ and $V_2$ (via associated actuators also represented by the valve symbols) to admit water to the vessel 10. When the weight $W_1$ of the admitted water reaches the pre-set or measured level $K_1$, as determined by comparison of signal values $K_1$ and $W_1$, the valves $V_1$ and $V_2$ are closed by the computer. Next, cement is delivered into the vessel, for mixing with water, and for this purpose, the computer effects operation of drive $D_1$. When the weight $W_2$ of the admitted cement reaches the preset measured level $K_2$ as determined by comparison of signal values $K_2$ and $W_2$, the drive $D_1$ is stopped.

Also, provided is agitation means for agitating and thereby mixing the cement and water in the vessel, to form a slurry, in which the cement particles are thoroughly wetted, for optimum strength concrete production. The agitation means, generally indicated at 25 in FIG. 2 includes multiple rotary agitators in the lower interior 26 of the vessel 10, i.e. inwardly of wall lower extension 11a. As shown, the agitators includes an upper bladed agitator 27 mounted on a vertical drive shaft 28, and a lower bladed agitator 29 also mounted on shaft 28, and extending directly below agitator 27. Shaft 28 extends upwardly and to the vessel exterior above the cover. A drive $D_2$ including a motor is connected to the upper end of the shaft, and support bearing means for the shaft is seen at 129. Suitable seals are also provided.

The blades 27*a* of the upper agitator are angled relative to horizontal so as to drive slurry in a downward stream 27*b*, and the blades 29*a* of the lower agitator are angled relative to horizontal and oppositely to the blades 29*a* of the upper agitator so as to drive slurry in an upward stream 29*b* toward the upper agitator. As a result the two streams impinge from one another for enhancing wetting of the cement particles, and flow outwardly and downwardly as well as outwardly and upwardly. Also, vortexing flow in the vessel is substantially reduced, which also contributes to enhance wetting of the cement particles. If desired, the two bladed rotors can be separately driven. Each agitator typically includes four blades, and the agitator shaft may be rotated at between 140 and 180 RPM—preferably about 160 RPM.

Furthermore, a pump P is carried at the bottom outlet 36 of the vessel to receive or remove a stream of slurry from the vessel and to flow the slurry via duct 38 into the mix at the upper interior of the vessel 10 and at high velocity. Drive $D_3$ including a motor serves to rotate the pump impeller at high speed (1,000 RPM, for example), to create the high velocity stream of slurry that is caused to impinge upon the slurry in the vessel, after being jetted tangentially relative to wall 11, from duct outlet 39, (FIG. 3). Further, agitation, and enhanced wetting of the cement particles is thereby achieved. Pump P is also operable in a second mode to pump slurry from the lower interior of the vessel and via duct 40 to an auxiliary mixing vessel 41, after opening of a discharge valve $V_6$ seen in FIG. 4. Vessel 41 is typically a rotating container on a ready-mix truck transporting concrete to a job site for pouring. Aggregate (sand and rock) is added in measured amount to the vessel 41, at 42.

Also provided is washing means, including a wash water holding tank 43, for supplying pressurized wash water to the interior of the vessel 10, to wash remanent slurry from surfaces (such as wall surfaces and agitator surfaces) in the vessel. Such wash water and remanent slurry then flows to the auxiliary vessel via the pump P. A fixed or predetermined fraction (preferably about 5%) of the required water for the ultimate mix in vessel 41 is supplied to the holding tank 43, as via line 45 and valves $V_3$ and $V_4$ seen in FIG. 1, for use in washing down the interior surfaces as described. Three flushing lines 46 extend to spray nozzles 47 in the vessel upper interior, from a pipe or manifold 48 connected with lowermost interior of tank 43 as via a control valve $D_7$. Also, a wash water line 50 extends from pipe 48 to the pump housing for washing pump surfaces free of remanent slurry. Computer 19 is programmed to open valve $V_7$ to flow or pass water to lines 46 and 50, after all of the slurry has been pumped from vessel 10 to flow to vessel 41, at 40. A source of air pressure is shown at 210 and connected to tank 43. After completion of washdown, valves $V_6$ and $V_7$ are closed.

Figure 2:
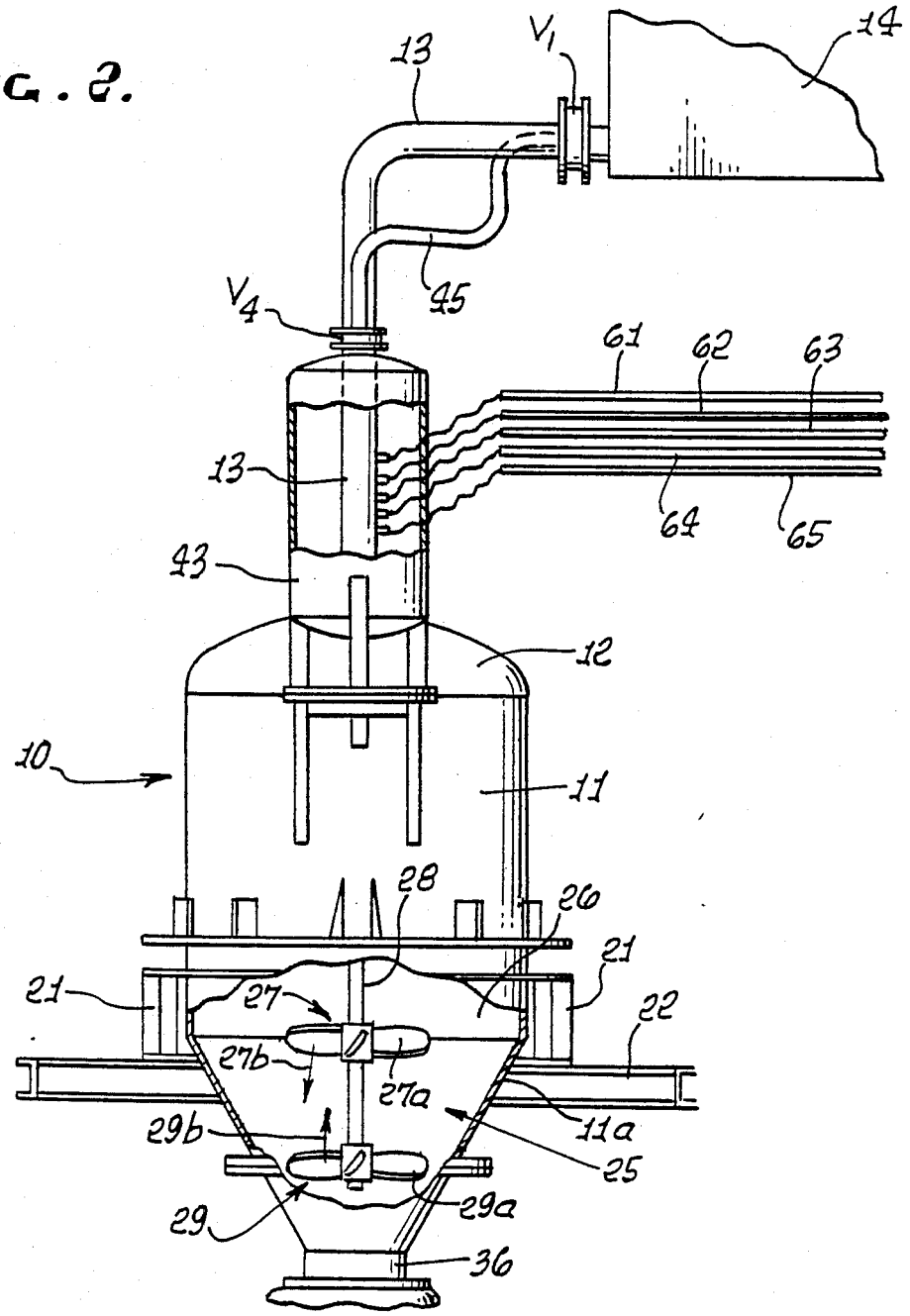
FIG. 2 is a right side elevation taken on lines 2—2 of FIG. 1, and partly broken away to show interior construction of the primary mixing vessel.
Figure 4:
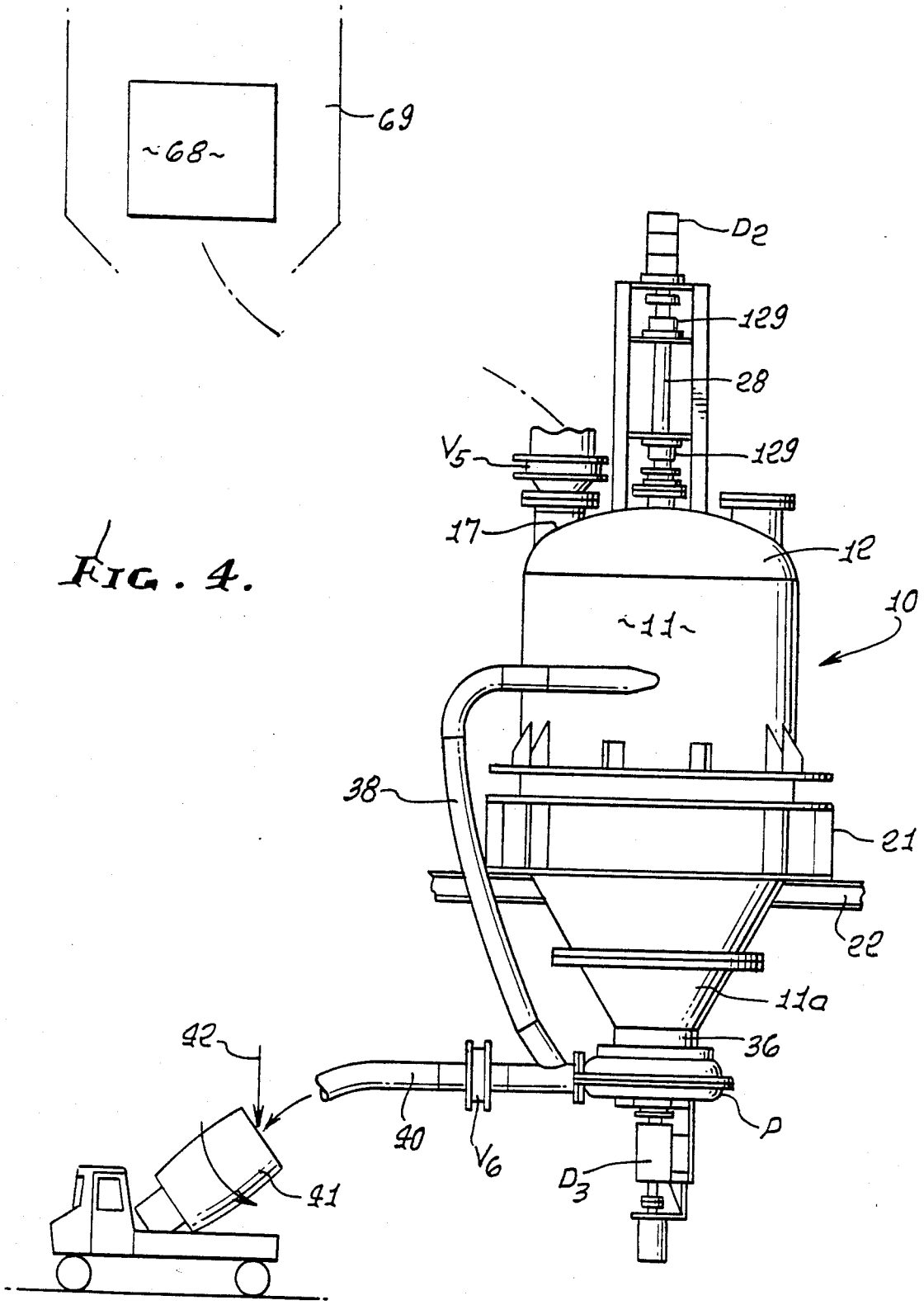
FIG. 4 is a left side elevation taken on lines 4—4 of FIG. 1.
Figure 1:
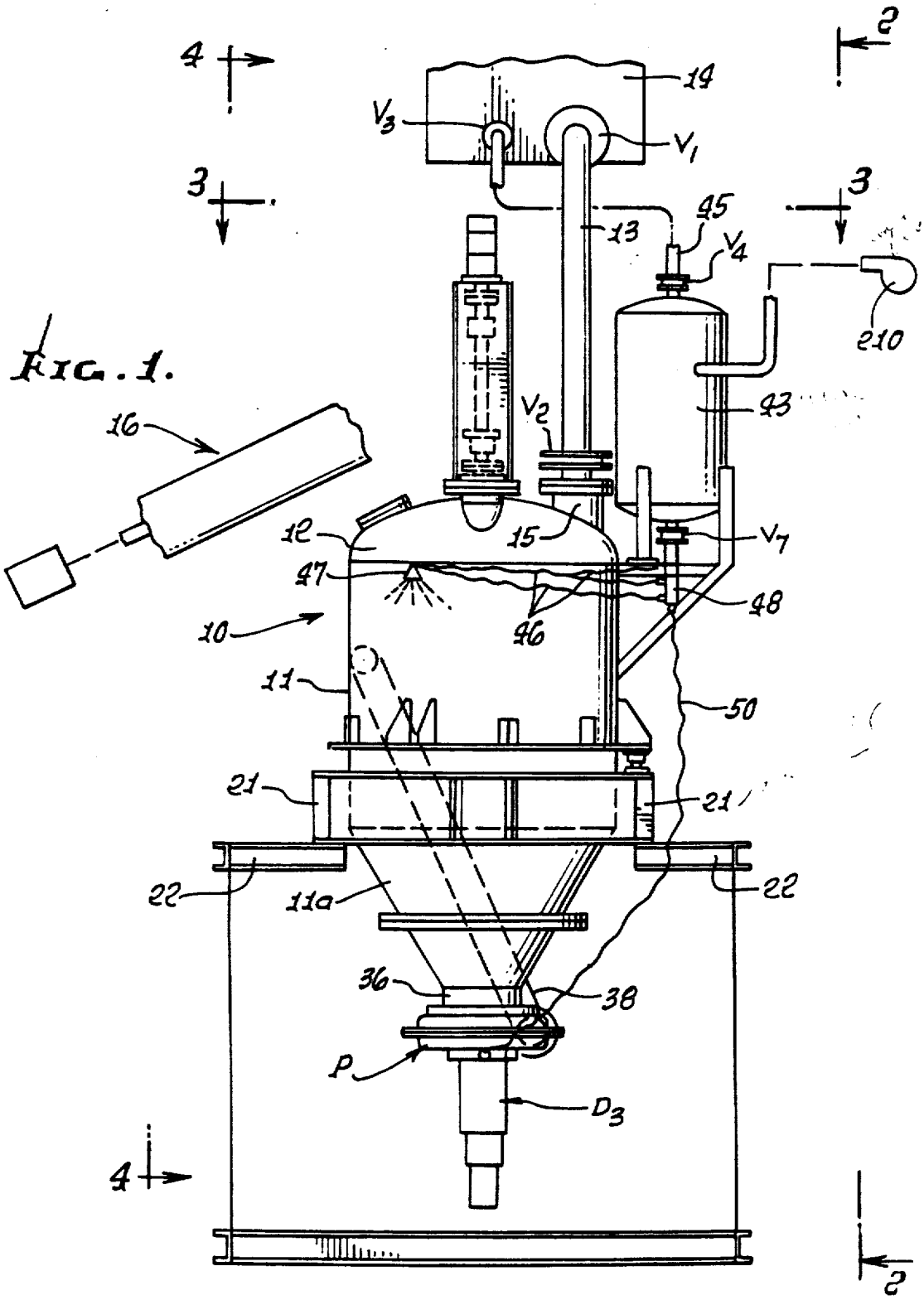

All of the valves $V_1$-$V_7$ may be operated by computer-controlled air-operated actuators. FIG. 2 also shows lines 61–64 connected to the water inlet duct 13, for passing selected additives or other admixture agents, to the vessel interior. FIG. 4 also shows a vibrator 68 connected to a cement supply silo 69 from which cement is conveyed to vessel 10. At such time as cement inlet gate valve $V_5$ opens, just after completion of water input to vessel 10, the vibrator is energized so as to effect gravity flow of cement to the conveyor. At that time, the agitator drive is energized and the pump drive is also energized, under computer control. Air pressure is also admitted to the holding tank. After completion of cement input to the vessel 10, $V_5$ is closed, and the vibrator is de-energized. For initial water input, valves $V_1$, $V_2$, $V_3$ and $V_4$ are all opened simultaneously.

Figure 6:
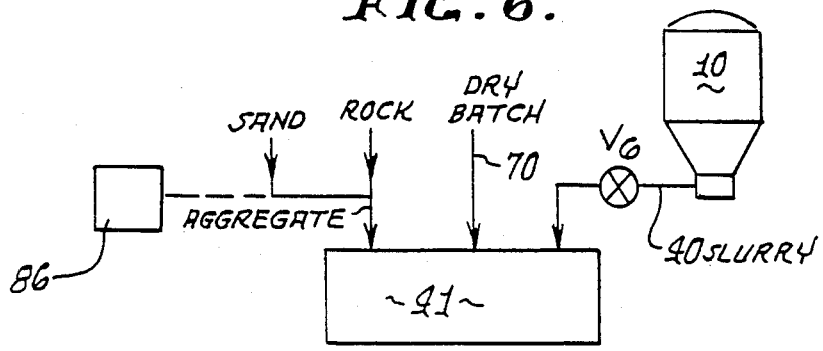
FIG. 6 is a block diagram showing operation of an auxiliary mixing vessel.

The apparatus and method to produce slurry (wet batching) can also be used in conjunction with dry batching. Thus, a predetermined proportion of the ultimate mix in vessel 41 can be supplied by the wet batching process as described; and also, the balance of the ultimate cement and water mix in vessel 41 can be supplied by dry batching—i.e. loading dry cement and water directly into that vessel (see arrow 70, in FIG. 6).

Even further wetting of cement particles in the slurry can be effected by evacuating air from the interior of the primary vessel after mixing of the water and cement, then rapidly re-admitting air to the primary vessel, thereby enhancing wetting of the cement particles in the slurry. See for example the air evacuation line 80 in FIG. 3, connected with the tank upper interior and leading to an evacuation pump $P_2$. Air can be suddenly re-admitted to the tank by opening a valve $V_8$ to 80, under control of the computer, as during the slurry mixing process.

Finally, a sensor 86 is associated with the computer for sensing the amount of water per unit volume of wet sand added to the auxiliary vessel 41, whereby the computer then calculates the diminished amount of water to be added to the vessel 10 in the first instance, as by control of valves $V_1$-$V_4$, so that an ultimate correct formula mix is produced in vessel 41.

It is also possible to omit agitators 27 and 29 or drive for such agitators and instead employ the centrifugal pump P operated in such a way that is impeller inlet side, exposed to slurry in the lower interior of the vessel 11, induces rotations of the lower slurry in one rotary direction about the tank central vertical axis. At the same time, the amount of slurry recirculated to the tank upper interior, via line 38, is controlled, and the slurry outlet nozzle is directed so as to drive slurry in the upper interior of the vessel in another rotary direction (i.e. opposite to said one rotary direction, about axis 80. As a result, the two opposite rotary streams interfere with one another as in shear, and a very high degree of particle setting is achieved, as is desirable for high strength concerte. In one example, about 10% of the slurry in the tank is continuously recirculated at 38. Also, the particle wetting effect is enhanced by creating a partial vacuum in the tank interior withdrawing air from the tank upper interior. In this regard, voids adjacent cement and other particles created by loss of air are replaced by water. Operation of the pump P itself may create some of such vacuum.

In another arrangement, means is provided for aspirating cement dust particles from the upper interior of the vessel 11, and for circulating them to the recirculated slurry, as in line 38. For this purpose a line may extend upwardly from the top of the vessel, and back downwardly to discharge aspirated air. A branch line then connects to the side of the vent line to aspirate rising dust particles sidewardly from the rising air streams. The dust particles travel in the bran line under vacuum created by slurry travel in line 38, to which the branch line connects as at a venturi. Thus, no cement dust is wasted, but is recirculated and fully utilized.

We claim:

1. The method of mixing particulate cement and water in a primary mixing vessel to form a slurry batch, that includes:

(a) introducing a measured quantity of water into the vessel, (b) introducing a measured quantity of particulate cement into the vessel, (c) agitating the water and cement in the vessel to form a slurry, (d) and, while continuing said agitating, pumping slurry from the lower interior extent of the vessel and delivering the pumped slurry to the upper interior of the vessel, at high velocity, (e) removing slurry from the vessel for flow to an auxiliary mixing vessel for mixing with aggregate, (f) and employing wash water to wash remanent slurry from surfaces in the primary mixing vessel for flow to the auxiliary vessel.

2. The method of claim 1 wherein multiple rotary agitators are employed in the primary vessel, and operating said agitators to create streams of slurry which impinge upon one another in that vessel.

3. The method of claim 2 wherein said agitators include an upper agitator and a lower agitator below the upper agitator, the agitators rotated in a direction or directions so that the upper agitator drives slurry in a stream toward the lower agitator, and so that the lower agitator drives slurry in a stream toward the upper agitator, whereby the two streams impinge upon one another.

4. The method of claim 3 including flowing the pumped slurry to the primary tank interior to flow in counter current relation to at least one of the streams created by said agitation.

5. The method of claim 1 wherein a wash water holding tank is provided, and including adding to said holding tank a fixed fraction of said predetermined amount of water, for use as said wash water.

6. The method of claim 5 including pressurizing the wash water in the holding tank, for delivery in a pressurized stream or streams to the vessel interior to wash down said surfaces in the primary mixing vessel.

7. The method of claim 6 wherein air pressure is delivered to the holding tank after said predetermined amount of water is introduced to the primary vessel.

8. The method of claim 1 including evacuating air from the interior of the primary vessel after mixing of the water and cement, then rapidly re-admitting air to the primary wheel, thereby enhancing wetting of the cement particles in the slurry.

9. The method of claim 1 including mixing the slurry delivered to the auxiliary vessel with aggregate delivered to the auxiliary vessel while transporting the auxiliary vessel to a concrete pour site.

10. The method of claim 9 wherein the amount of water added to the primary mixing vessel is less than the ultimate water content of the mix in the auxiliary vessel, by a differential equal to the water content of the aggregate added to the auxiliary vessel.

11. The method of claim 1 wherein said agitating of the water and cement in the vessel is effected by directing the slurry pumped to the upper interior of the vessel at an angle to drive slurry in an upper region of the vessel in one rotary path in the vessel.

12. The method of claim 11 wherein said pumping of the slurry from lower interior extent of the vessel is effected to induce slurry in a lower region of the vessel to travel in another rotary path in the vessel.

13. The method of claim 12 wherein the directions of said two rotary paths are generally opposite to each other.

14. The method of claim 13 wherein the two paths are about an upright axis in the vessel.

15. The method of claim 1 including aspirating cement dust particles from the upper interior of the vessel for circulation into the slurry being pumped to the upper interior of the vessel.

16. The method of claim 15 including separating air from the aspirated dust particles, and discharging such air.

17. Apparatus for mixing particulate cement and water to form a slurry batch that is then flowable to an auxiliary mixing vessel to which aggregate is supplied, comprising:

(a) a primary mixing vessel having cement and water inlet means, and slurry outlet means, (b) means for introducing measured quantities of water and cement into the primary vessel, (c) agitation means for agitating the cement and water in the primary vessel, thereby to form the slurry, (d) means including a pump for removing a stream of slurry from the lower interior of the primary vessel and flowing said stream into the upper interior of the primary vessel, at high velocity, and for removing slurry from the primary vessel for flow to said auxiliary mixing vessel for mixing with aggregate, (e) and washing means including a wash water holding tank for supplying wash water to the interior of the primary vessel so as to wash remanent slurry from surfaces in that primary vessel for flow out of the primary vessel and to the auxiliary vessel.

18. Apparatus as defined in claim 17 wherein the agitation means includes multiple rotary agitators in the primary vessel, and drive means to rotate the agitators thereby to create streams of slurry which impinge upon one another in that primary vessel.

19. Apparatus as defined in claim 18 wherein said agitators include an upper bladed agitator and a lower bladed agitator below the upper agitator, said drive means operating to rotate the agitators in a direction or directions such that the upper agitator drives slurry in a first stream toward the lower agitator, and such that the lower agitator drive slurry in in a second stream toward the upper agitator, whereby the two streams impinge upon one another for enhancing wetting of the cement particles.

20. Apparatus as defined in claim 17 including means for adding to the holding tank a fixed fraction of the water introduced to the primary vessel, for use as said wash water.

21. Apparatus as defined in claim 20 including pressurizing means operatively connected to the holding tank to pressurize the water in that tank, thereby to enable delivery of said wash water in a pressurized stream or streams to the primary vessel interior to wash down said surfaces in that vessel.

22. Apparatus as defined in claim 21 wherein said washing means includes pressurized wash water spray nozzles in the upper interior of the primary vessel.

23. Apparatus as defined in claim 21 wherein said pressurizing means includes a source of air pressure operatively connected with said holding tank, and including control means for effecting pressurizing of the wash water in the holding tank subsequent to introduction of water to the primary vessel.

24. The apparatus of claim 17 including control means for operating the pump in a first mode to flow the slurry stream at high velocity into the upper interior of the primary vessel, and for operating the pump in a second and subsequent mode to remove slurry from the primary vessel and flow it to the auxiliary mixing vessel.

25. Apparatus as defined in claim 17 which includes:

(i) first valving for controlling water and cement flow into the primary vessel, (ii) second valving for controlling flow to the holding tank of a fixed fraction of the water flow to the primary mixing vessel, (iii) other valving to control operation of the pump in said first and second modes, and (iv) means including a computer to control operation of said first, second and other valving.

26. The apparatus of claim 17 including means for aspirating cement dust particles from the upper interior of the primary vessel for circulating into the slurry being pumped to the upper interior of the primary vessel.

27. The apparatus of claim 26 including means for separating air from the aspirated dust particles, and for discharging such separated air.

* * * * *

REEXAMINATION CERTIFICATE (1575th)

United States Patent [19]

Dunton et al.

[11] B1 4,830,505

[45] Certificate Issued Oct. 15, 1991

[54] PARTICLE WETTING PROCESS AND APPARATUS

[75] Inventors: Harvey R. Dunton, Anaheim; Donald H. Rez, Newport Beach, both of Calif.

[73] Assignee: Standard Concrete Products, Inc., Santa Ana, Calif.

Reexamination Request:
No. 90/001,972, Mar. 26, 1990

Reexamination Certificate for:

| | |
|---|---|
| Patent No.: | **4,830,505** |
| Issued: | **May 16, 1989** |
| Appl. No.: | **194,227** |
| Filed: | **May 16, 1988** |

[51] Int. Cl.[5] ..... B28C 5/08

[52] U.S. Cl. ..... 366/2; 366/14; 366/16; 366/28; 366/34; 366/136; 366/138

[58] Field of Search ..... 366/2, 6, 14, 15, 16, 366/17, 18, 19, 33, 34, 40, 136, 137, 141, 152, 159

[56] References Cited

U.S. PATENT DOCUMENTS

| | | | |
|---|---|---|---|
| 2,513,012 | 6/1950 | Dugas . | |
| 2,718,471 | 9/1955 | Samler | 106/181 |
| 3,006,615 | 10/1961 | Mason, Jr. . | |
| 3,081,983 | 3/1963 | Thibodeaux | 259/178 |
| 3,199,795 | 8/1965 | Bennet et al. . | |
| 3,459,409 | 8/1969 | Goldberger . | |
| 3,580,547 | 5/1971 | Amorese . | |
| 3,967,815 | 7/1976 | Backus et al. . | |
| 4,007,921 | 2/1977 | Zingg | 259/151 |
| 4,225,247 | 9/1980 | Hodson . | |
| 4,225,457 | 9/1980 | Hodson . | |
| 4,257,710 | 3/1981 | Delcoigne et al. . | |
| 4,272,198 | 6/1981 | Velikov et al. . | |
| 4,296,934 | 10/1981 | Atkin . | |
| 4,302,127 | 11/1981 | Hodson . | |
| 4,383,768 | 5/1983 | Kupka . | |
| 4,384,787 | 5/1983 | Ito et al. . | |
| 4,398,842 | 8/1983 | Hodson . | |
| 4,435,018 | 3/1984 | Del Fabbro . | |
| 4,488,815 | 12/1984 | Black . | |
| 4,588,299 | 5/1986 | Brown | 366/18 |
| 4,614,435 | 9/1986 | McIntire . | |
| 4,750,843 | 6/1988 | Endtner et al. . | |
| 4,764,022 | 8/1988 | DiVita . | |
| 4,850,704 | 7/1989 | Zimmerly et al. . | |

FOREIGN PATENT DOCUMENTS

| | | |
|---|---|---|
| 15024 | 11/1971 | Australia . |
| 27623 | 11/1984 | Australia . |
| 1482370 | 8/1977 | Denmark . |
| 1557002 | 5/1970 | Fed. Rep. of Germany . |
| 1214735 | 12/1970 | Fed. Rep. of Germany . |
| 2000201 | 5/1971 | Fed. Rep. of Germany . |
| 3113129 | 1/1982 | Fed. Rep. of Germany . |
| 3117648 | 11/1982 | Fed. Rep. of Germany . |
| 3127858 | 2/1983 | Fed. Rep. of Germany . |
| 3436813 | 5/1986 | Fed. Rep. of Germany . |
| 2261851 | 9/1975 | France . |
| 2486441 | 1/1982 | France . |
| 1116656 | 6/1968 | United Kingdom . |
| 1265115 | 3/1972 | United Kingdom . |
| 2196548 | 5/1988 | United Kingdom . |

*Primary Examiner*—Robert W. Jenkins

[57] ABSTRACT

A method of mixing particulate cement and water in a primary mixing vessel to form a slurry batch, includes introducing a measured quantity of water into the vessel, introducing a measured quantity of particulate cement into the vessel, agitating the water and cement in the vessel to form a slurry, and while continuing such agitating, pumping slurry from the lower interior extend of the vessel and delivering the pumped slurry to the upper interior of the vessel, at high velocity, removing slurry from the vessel for flow to an auxiliary mixing vessel for mixing with aggregate, and employing wash water to wash remanent slurry from surfaces in the primary mixing vessel for flow to the auxiliary vessel.

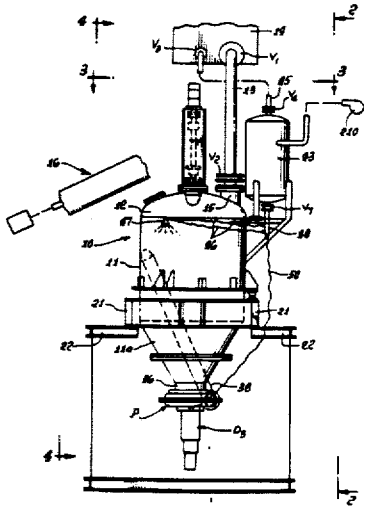

4
3
2
14
V3
V1
13
45
V4
210
43
V2
16
12
15
V7
47
48
46
10
11
50
21
21
22
22
11a
36
38
P
D3

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 4, 8, 15, 17, 18, 19, 25 and 26 are determined to be patentable as amended.

Claims 2, 5–7, 9, 10, 11, 12–14, 16, 20–24 and 27, dependent on an amended claim, are determined to be patentable.

New claims 28–41 are added and determined to be patentable.

1. The method of mixing particulate cement and water in a primary mixing vessel *having an inverted lower frusto-conical interior,* to form a slurry batch, that includes:

(a) introducing a measured quantity of water into the vessel, (b) introducing a measured quantity of particulate cement into the vessel, (c) agitating the water and cement in the vessel to form a slurry [, ( )] *comprising the steps of using an impeller inlet side of a pump exposed to lower slurry in the inverted lower frusto-conical interior of the vessel for inducing rotation of the lower slurry in one rotary direction about the vessel central vertical axis* [d] and while continuing said agitating, pumping slurry from the lower interior extent of the vessel and delivering the pumped slurry to the upper interior of the vessel, at high velocity,

[(e)] *(d)* removing slurry from the vessel for flow to an auxiliary mixing vessel for mixing with aggregate, *and*

[(f) and] *(e)* employing wash water to wash [remanent] *remnant* slurry from surfaces in the primary mixing vessel for flow to the auxiliary vessel.

3. [The method of claim 2 wherein said agitators include an upper agitator and a lower agitator below the upper agitator, the agitators rotated] *The method of mixing particulate cement and water in a primary mixing vessel to form a slurry batch, and including multiple rotary agitators in the primary vessel comprising an upper agitator and a lower agitator below the upper agitator, the method including the steps of:*

*(a) introducing a measured quantity of water into the vessel,*

*(b) introducing a measured quantity of particulate cement into the vessel,*

*(c) agitating the water and cement in the vessel to form a slurry,*

*(d) while continuing said agitating, pumping slurry from the lower interior extent of the vessel and delivering the pumped slurry to the upper interior of the vessel, at high velocity,*

*(e) removing slurry from the vessel for flow to an auxiliary mixing vessel for mixing with aggregate,*

*(f) employing wash water to wash remnant slurry from surfaces in the primary mixing vessel for flow to the auxiliary vessel, and*

*(g) rotating the agitators* in a direction or directions so that the upper agitator drives slurry in a stream toward the lower agitator [,] and so that the lower agitator drives slurry in a stream toward the upper agitator, whereby the two streams impinge upon [one another] *each other in the vessel.*

4. The method of claim 3 including flowing the pumped slurry to the primary [tank] *vessel* interior to flow in counter current relation to at least one of the streams created by said agitation.

8. [The method of claim 1 including] *The method of mixing particulate cement and water in a primary mixing vessel to form a slurry batch, that includes:*

*(a) introducing a measured quantity of water into the vessel,*

*(b) introducing a measured quantity of particulate cement into the vessel,*

*(c) agitating the water and cement in the vessel to form a slurry,*

*(d) while continuing said agitating, pumping slurry from the lower interior extent of the vessel and delivering the pumped slurry to the upper interior of the vessel, at high velocity,*

*(e) removing slurry from the vessel for flow to an auxiliary mixing vessel for mixing with aggregate,*

*(f) employing wash water to wash remnant slurry from surfaces in the primary mixing vessel for flow to the auxiliary vessel, and*

(g) evacuating air from the interior of the primary vessel after mixing of the water and cement, then rapidly readmitting air to the primary [wheel] *vessel,* thereby enhancing wetting of the cement particles in the slurry.

15. [The method of claim 1 including] *The method of mixing particulate cement and water in a primary mixing vessel to form a slurry batch, that includes:*

*(a) introducing a measured quantity of water into the vessel,*

*(b) introducing a measured quantity of particulate cement into the vessel,*

*(c) agitating the water and cement in the vessel to form a slurry,*

*(d) while continuing said agitating, pumping slurry from the lower interior extent of the vessel and delivering the pumped slurry to the upper interior of the vessel, at high velocity,*

*(e) removing slurry from the vessel for flow to an auxiliary mixing vessel for mixing with aggregate,*

*(f) employing wash water to wash remnant slurry from surfaces in the primary mixing vessel for flow to the auxiliary vessel, and*

(g) aspirating cement dust particles from the upper interior of the vessel for circulation into the slurry being pumped to the upper interior of the vessel.

17. Apparatus for mixing particulate cement and water to form a slurry batch that is then flowable to an auxiliary mixing vessel to which aggregate is supplied, comprising:

(a) a primary mixing vessel having *an inverted lower frusto-conical interior,* cement and water inlet means, and slurry outlet means, (b) means for introducing measured quantities of water and cement into the primary vessel, (c) agitation means for agitating the cement and water in the primary vessel, thereby to form the slurry[, (d)] *including lower slurry in the inverted lower frusto-conical interior of the vessel, the agitating means comprising* means including a pump for removing a stream of slurry from the lower interior of the primary vessel and flowing said stream into the upper interior of the primary vessel, at high velocity, and for removing slurry from the primary vessel for flow to said auxiliary mixing vessel for mixing with aggregate, *the pump having an impeller inlet side and an impeller outlet side, the inlet side being substantially larger than the outlet side and exposed to the lower slurry in the inverted lower frusto-conical interior of the vessel for inducing rotation of the lower slurry in one rotary direction about the vessel central vertical axis, and*

[(e) and] *(d)* washing means including a wash water holding tank for supplying wash water to the interior of the primary vessel so as to wash remanent slurry from surfaces in that primary vessel for flow out of the primary vessel and to the auxiliary vessel.

18. [Apparatus as defined in claim 17] *Apparatus for mixing particulate cement and water to form a slurry batch that is then flowable to an auxiliary mixing vessel to which aggregate is supplied, comprising:*

*(a) a primary vessel having cement and water inlet means and slurry outlet means,*

*(b) means for introducing measured quantities of water and cement into the primary vessel,*

*(c) agitation means for agitating the cement and water in the primary vessel, thereby to form the slurry,* wherein the agitation means includes multiple rotary agitators in the primary vessel, and drive means to rotate the agitators thereby to create streams of slurry which impinge upon one another in that primary vessel[.] ,

*(d) means including a pump for removing a stream of slurry from the lower interior of the primary vessel and flowing said stream into the upper interior of the primary vessel, at high velocity, and for removing slurry from the primary vessel for flow to said auxiliary mixing vessel for mixing with aggregate, and*

*(e) washing means including a wash water holding tank for supplying wash water to the interior of the primary vessel so as to wash remnant slurry from surfaces in that primary vessel for flow out of the primary vessel and to the auxiliary vessel.*

19. [Apparatus as defined in claim 18 wherein] *Apparatus for mixing particulate cement and water to flow a slurry batch that is then flowable to an auxiliary mixing vessel to which aggregate is supplied, comprising:*

*(a) a primary mixing vessel having cement and water inlet means, and slurry outlet means,*

*(b) means for introducing measured quantities of water and cement into the primary vessel,*

*(c) agitation means for agitating the cement and water in the primary vessel, thereby to form the slurry,*

*(d) means including a pump for removing a stream of slurry from the lower interior of the primary vessel and flowing said stream into the upper interior of the primary vessel, at high velocity, and for removing slurry from the primary vessel for flow to said auxiliary mixing vessel for mixing with aggregate, and*

*(e) washing means including a wash water holding tank for supplying wash water to the interior of the primary vessel so as to wash remnant slurry from surfaces in that primary vessel for flow out of the primary vessel and to the auxiliary vessel, and*

*the agitation means including multiple rotary agitators in the primary vessel,* said agitators include an upper bladed agitator and a lower bladed agitator below the upper agitator, said drive means operating to rotate the agitators in a direction or directions such that the upper agitator drives slurry in a first stream toward the lower agitator[,] and such that the lower agitator [drive] *drives* slurry in [in] a second stream toward the upper agitator, whereby the two streams impinge upon one another for enhancing wetting of the cement particles.

25. [Apparatus as defined in claim 17 which includes:] *Apparatus for mixing particulate cement and water to form a slurry batch that is then flowable to an auxiliary mixing vessel to which aggregate is supplied, comprising:*

*(a) a primary mixing vessel having cement and water inlet means, and slurry outlet means,*

*(b) means for introducing measured quantities of water and cement into the primary vessel,*

*(c) agitation means for agitating the cement and water in the primary vessel, thereby to form the slurry,*

*(d) means including a pump for removing a stream of slurry from the lower interior of the primary vessel and flowing said stream into the upper interior of the primary vessel, at high velocity, and for removing slurry from the primary vessel for flow to said auxiliary mixing vessel for mixing with aggregate, and*

*(e) washing means including a wash water holding tank for supplying wash water to the interior of the primary vessel so as to wash remnant slurry from surfaces in that primary vessel for flow out of the primary vessel and to the auxiliary vessel, and*

[(i)] *(f)* first valving for controlling water and cement flow into the primary vessel,

[(ii)] *(g)* second valving for controlling flow to the holding tank of a fixed fraction of the water flow to the primary mixing vessel,

[(iii)] *(h)* other valving to control operation of the pump in [said] *a* first *mode for flowing the slurry into the upper interior of the primary vessel* and *in a* second [modes] *mode for flowing the slurry to the auxiliary vessel,* and

[(iv)] *(i)* means including a computer to control operation of said first, second and other valving.

26. [The apparatus of claim 17 including] *Apparatus for mixing particulate cement and water to form a slurry batch that is then flowable to an auxiliary mixing vessel to which aggregate is supplied, comprising:*

*(a) a primary mixing vessel having cement and water inlet means, and slurry outlet means,*

*(b) means for introducing measured quantities of water and cement into the primary vessel,*

*(c) agitation means for agitating the cement and water in the primary vessel, thereby to form the slurry,*

*(d) means including a pump for removing a stream of slurry from the lower interior of the primary vessel and flowing said stream into the upper interior of the primary vessel, at high velocity, and for removing slurry from the primary vessel for flow to said auxiliary mixing vessel for mixing with aggregate, and*

*(e) washing means including a wash water holding tank for supplying wash water to the interior of the primary vessel so as to wash remnant slurry from surfaces in that primary vessel for flow out of the primary vessel and to the auxiliary vessel, and*

(*f*) means for aspirating cement dust particles from upper interior of the primary vessel for circulating into the slurry being pumped to the upper interior of the primary vessel.

*28. The method of claim 1 wherein the step of pumping the slurry along a path comprises the step of pumping the slurry through a duct to the upper interior of the vessel.*

*29. The method of claim 1 wherein the step of removing the slurry comprises the step of pumping slurry from the vessel at high speed to the auxiliary mixing vessel.*

*30. The method of claim 29 comprising the step of performing each of the steps of pumping with the same pump and diverting the slurry from the pump to the auxiliary vessel or to the upper interior of the vessel.*

*31. The method of claim 1 comprising the step of weighing the primary mixing vessel with the water and cement.*

*32. Apparatus as defined in claim 17 comprising a duct for passing the stream of slurry, separate from the slurry inthe primary vessel, into the upper interior of the primary vessel.*

*33. Apparatus as defined in claim 17 wherein the pump pumps the slurry from the primary mixing vessel through the outlet means to the auxiliary mixing vessel at high speed.*

*34. Apparatus as defined in claim 17 comprising means for weighing the primary vessel with the water and cement.*

*35. Apparatus as defined in claim 25 wherein the other valving comprises valving adapted for directing the slurry drawn by the pump out of the primary vessel either into the stream back into the upper interior of the primary vessel or into a stream to the auxiliary mixing vessel.*

*36. Apparatus as defined in claim 26 comprising a duct for flowing the stream of slurry separate from the slurry in the vessel to the upper interior of the primary mixing vessel.*

*37. The method of one of claims 8, 11 or 15 wherein the step of pumping and delivering the pumped slurry comprises the step of flowing the pumped slurry separate from the slurry in the vessel through a duct to the upper interior of the vessel.*

*38. The method of mixing particulate cement and water in a primary mixing vessel, having an inverted lower frusto-conical interior, to form a slurry batch, that includes:*

*(a) introducing a measured quantity of water into the vessel,*

*(b) introducing a measured quantity of particulate cement into the vessel,*

*(c) agitating the water and cement in the vessel to form a slurry comprising the step of using an impeller inlet side of a pump exposed to lower slurry in the inverted lower frusto-conical interior of the vessel for inducing rotation of the lower slurry in one rotary direction about the vessel central vertical axis, and, while continuing said agitating, using the pump for pumping slurry along a path separate from the slurry in the vessel from the lower interior extent of the vessel and delivering the pumped slurry to the upper interior of the vessel, at high velocity,*

*(d) removing slurry from the vessel for flow to an auxiliary mixing vessel for mixing with aggregate, and*

*(e) employing wash water to wash remnant slurry from surfaces in the primary mixing vessel for flow to the auxiliary vessel.*

*39. The method of clain 38 wherein the step of using an impeller inlet side of a pump comprises the step of using a pump inlet side of a pump which is substantially larger than the outlet side of the pump.*

*40. Apparatus for mixing particulate cement and water to form a slurry batch that is then flowable to an auxiliary mixing vessel to which aggregate is supplied, comprising:*

*(a) a primary mixing vessel having an inverted lower frusto-conical interior, cement and water inlet means and slurry outlet means,*

*(b) means for introducing measured quantities of water and cement into the primary vessel through the inlet means,*

*(c) agitation means for agitating the cement and water in the primary vessel, thereby to form the slurry, including lower slurry in the inverted lower frusto-conical interior of the vessel, the agitating means comprising means including a pump for removing a stream of slurry from the lower interior of the primary vessel and flowing said stream separate from the slurry in the primary vessel into the upper interior of the primary vessel, at high velocity, and for removing slurry from the primary vessel for flow through the outlet means to said auxiliary mixing vessel for mixing with aggregate, the pump comprising a impeller inlet side and a impeller outlet side, the inlet side being substantially larger than the outlet side and exposed to lower slurry in the inverted lower frusto-conical interior of the vessel for inducing rotation of the lower slurry in one rotary direction about the vessel central vertical axis, and*

*(d) washing means including a wash water holding tank for supplying wash water to the interior of the primary vessel so as to wash remnant slurry from surfaces in that primary vessel for flow out of the primary vessel and to the auxiliary vessel.*

*41. The method of claim 1 wherein the step of using an impeller inlet side of a pump comprises the step of using a pump inlet side of a pump which is substantially larger than the outlet side of the pump.*

* * * * *